US006263818B1

(12) United States Patent
Dietens et al.

(10) Patent No.: US 6,263,818 B1
(45) Date of Patent: Jul. 24, 2001

(54) SPLIT MONOHULL VESSEL

(75) Inventors: Walter A. Dietens, Herentals (BE); Harris I. Knecht; Fernando C. Frimm, both of Houston, TX (US)

(73) Assignee: Exmar Offshore Company, Houston, TX (US)

( * ) Notice: Subject to any disclaimer, the term of this patent is extended or adjusted under 35 U.S.C. 154(b) by 0 days.

(21) Appl. No.: 09/416,842

(22) Filed: Oct. 12, 1999

Related U.S. Application Data

(63) Continuation-in-part of application No. 09/296,898, filed on Apr. 22, 1999, now abandoned.
(60) Provisional application No. 60/083,006, filed on Apr. 24, 1998.

(51) Int. Cl.[7] ..... B63B 1/00
(52) U.S. Cl. ..... 114/56.1; 114/61.1; 114/77 R
(58) Field of Search ..... 114/56.1, 247, 114/248, 249, 77 R, 61.1, 77 A, 61.22

(56) References Cited

U.S. PATENT DOCUMENTS

| | | | | |
|---|---|---|---|---|
| 1,266,362 | * | 5/1918 | Wells | 114/77 R |
| 2,773,468 | | 12/1956 | Besse . | |
| 3,345,970 | * | 10/1967 | De Long | 114/248 |
| 3,508,514 | | 4/1970 | Vienna . | |
| 4,031,843 | * | 6/1977 | Colin | 114/247 |
| 4,856,446 | * | 8/1989 | Herard | 114/61.22 |
| 5,428,881 | | 7/1995 | Woolery . | |

FOREIGN PATENT DOCUMENTS

| | | |
|---|---|---|
| 2510383 | 9/1976 | (DE) . |
| 2904245 | 8/1980 | (DE) . |
| 3119765 | 12/1982 | (DE) . |
| 0453141 | 10/1991 | (EP) . |
| 2032062 | 11/1970 | (FR) . |
| 2046001 | 3/1971 | (FR) . |
| 2068599 | 8/1971 | (FR) . |

OTHER PUBLICATIONS

"Shortsea sector is key to European transport system," The Motor Ship, vol. 73, No. 869, Dec. 1992, pp. 41–42.

PCT Search Report dated Jul. 28, 1999 for PCT/US99/08915.

Newspaper Article, unknown newspaper, unknown date; Tony Gray: "AESA wins Transocean drillship orders".

Notice of References Cited in U.S. Application 09/296,898.

* cited by examiner

*Primary Examiner*—Stephen Avila
(74) *Attorney, Agent, or Firm*—Rosenthal & Osha L.L.P.

(57) ABSTRACT

A drilling or other offshore application vessel which can have the outward appearance and other characteristic of a monohull vessel, comprised of two or more sub-hulls each of which may be sailed as an independent ship through restrictive waterways which would prevent passage of the assembled vessel. The sub-hulls are later joined together to form a composite drilling or other offshore application vessel. The sub-hulls in one example include a recessed portion which reduces the amount of ballast needed to balance the sub-hulls.

10 Claims, 4 Drawing Sheets

SPLIT MONOHULL VESSEL

CROSS REFERENCE TO RELATED APPLICATIONS

This application is a continuation-in-part of application Ser. No. 09/296,898 filed on Apr. 22, 1999 now abandoned, which application claims priority from U.S. Provisional Application No. 60/083,006 which was filed on Apr. 24, 1998.

FIELD OF THE INVENTION

The invention relates to water-borne vessels and more particularly to split hull ships.

BACKGROUND

The continuing search for oil and gas resources has led to exploration, drilling and production in a variety of offshore locations, some of which may involve travel by a vessel through waterways having size constraints which preclude the passage of typical monohull vessels. Ships, vessels, and offshore platforms which are too large to be practically towed or transported to these offshore locations have been assembled at the offshore destination site from multiple sub-assemblies which are separately towed or otherwise transported to the offshore destination site. However, these structures are not suitable substitutes for monohull vessels for various reasons, including economic ones.

Split hull ships, such as split hopper dredge ships, have been built and used for dredging operations. In such ships, the purpose of the split hull is not to facilitate transport through waterways which otherwise would restrict the size of the ship, but instead is intended to enable the ship to be filled during dredging operations, and the contents then "dumped" at a remote location. Split hopper dredge ships usually have deck hinges and bottom hydraulic jacks which permit controlled opening and closing of the hull at the bottom in "clamshell" fashion. Examples of split hopper dredge ships include the "Vlaanderen XX" operated by the Belgian company Baggerwerken Decloedt en Zoo N.V.

SUMMARY OF THE INVENTION

One aspect of the invention is a vessel comprising at least two sub-hulls and an attachment mechanism that joins the sub-hulls together. In one embodiment of the invention, the sub-hulls comprise independent vessels. In a particular embodiment of the invention, the sub-hulls form a symmetrical monohull vessel when joined together. In one embodiment of the invention the sub-hulls can be joined using fused bolt or sliding bolt foundations.

A particular embodiment of the invention includes a recessed portion on the side of each sub-hull which is to be joined to a corresponding side of another one of the sub-hulls. The recessed portion reduces the displaced volume of the joined side of the sub-hull so that an amount of ballast needed to balance the sub-hull is reduced. In one example of this embodiment, the volume of the recessed portion is selected so that with respect to the center line of the sub-hull the displaced volume of the joined side substantially matches the displaced volume of the other side of the sub-hull.

Another aspect of the invention is a method for assembling a vessel, comprising providing at least two sub-hulls and attaching the sub-hulls together.

DETAILED DESCRIPTION

Figure 1:
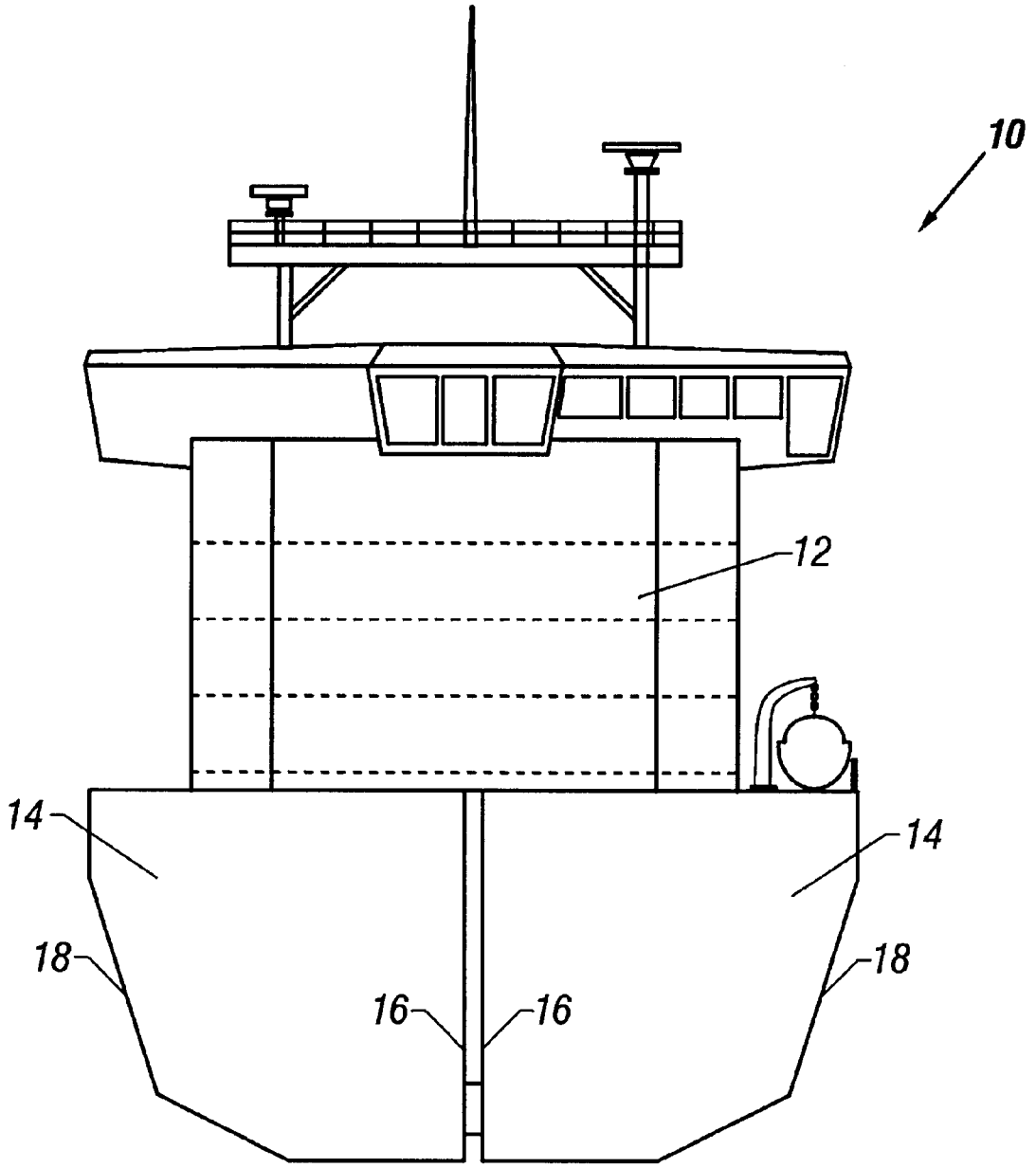
FIG. 1 shows a frontal view of one embodiment of a split monohull vessel.

Exemplary embodiments of the invention will be described with reference to the accompanying drawings. Like items in the drawings are shown with the same reference numbers.

The invention provides a cost effective method and design for a monohull-type drilling vessel and other offshore work or transport vessels when the dimensions of the vessel would otherwise exceed the constraints of the waterways through which the vessel must pass to reach its intended destination. This enables the use of a cost effective monohull design for such a vessel, with its attendant advantages. Such a vessel can be constructed with usual shipbuilding practices and normal shipbuilding materials including steel. This makes construction of the vessel possible virtually anywhere in the world. Assembly of the vessel at the intended destination also is cost effective. Self-erecting capability may be incorporated into the vessel design.

FIG. 1 shows a frontal view of an example of one embodiment of a split monohull vessel 10. The vessel 10 in this example is formed by the attachment of two sub-hulls 14 to each other. A superstructure 12 is shown attached across the sub-hulls 14 at the forward portion of the vessel 10. The sub-hulls 14 each can have a flat side 16 and a "ship-shaped" side 18. The flat sides 16 of each sub-hull 14 are brought together and are joined to form the vessel 10. The "ship-shaped" sides 18 form the exterior of the hull of the vessel 10. This will result in an assembled vessel 10 having the appearance of a symmetrical monohull vessel.

Figure 2:
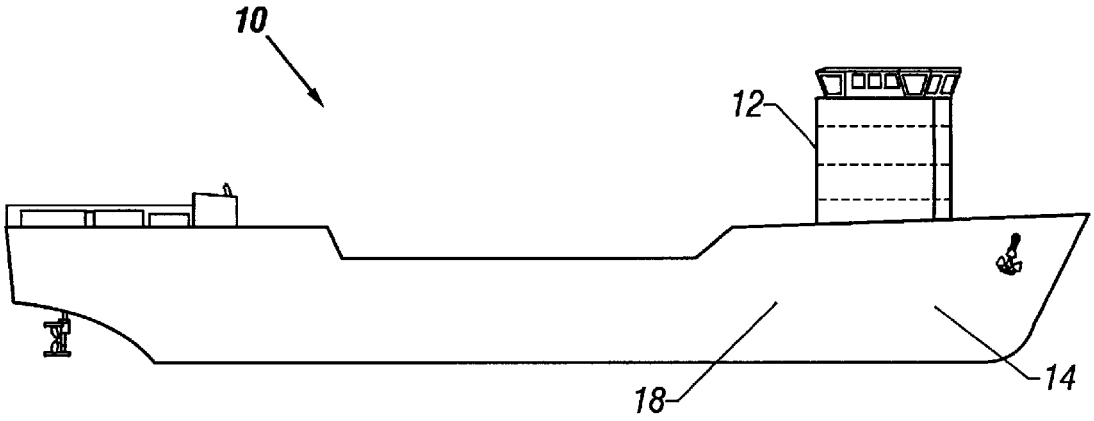
FIG. 2 shows a side view of one embodiment of a split monohull vessel.
Figure 3:
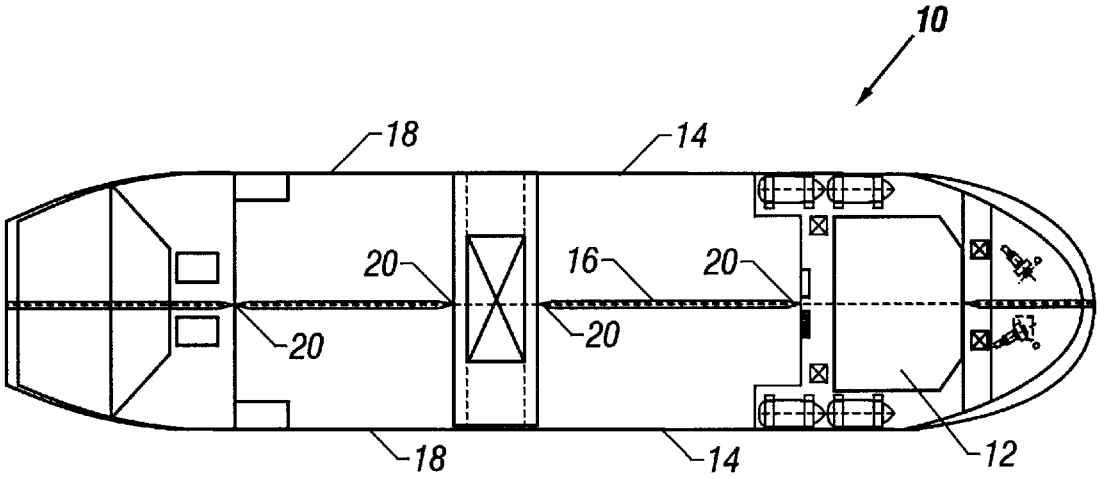
FIG. 3 shows an overhead view of one embodiment of a split monohull vessel.
Figure 4:
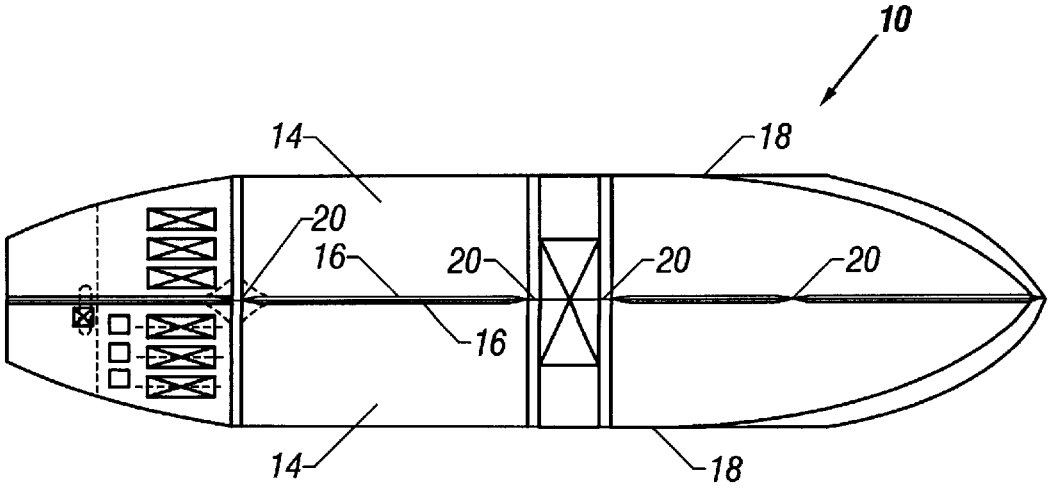
FIG. 4 shows a bottom view of one embodiment of a split monohull vessel.

FIG. 2 shows a side view of the example of the assembled vessel 10 with a sub-hull 14 and superstructure 12. FIG. 3 shows an overhead view of the assembled vessel 10. Multiple joining connections 20 are shown along the length of the flat sides 16 of the sub-hulls 14. FIG. 4 shows a bottom view of the assembled vessel 10 with the joining connections 20 shown at corresponding locations from FIG. 3 along the flat sides 16 of the sub-hulls 14.

The embodiment of the invention shown in the accompanying figures contemplates the use of at least two sub-hulls, each of which is capable of operation as a separate ship during transportation to the desired destination. However, alternative embodiments could use more than two sub-hulls. At the desired destination, the separate sub-hulls may be joined together to form a single vessel with the outward appearance of a monohull vessel. Once joined, the assembled vessel may have characteristics which are similar to those of an ordinary monohull ship, while having even a higher level of safety than an ordinary monohull ship as a result of the compartmentalization resulting from the use of multiple sub-hulls. For example, the vessel may be comprised of two separate sub-hulls, each of which is built as an independent ship. The two sub-hulls may be shaped like a longitudinally split monohull vessel; each of the two sub-hulls may have a flat side and a more typically ship-shaped side. While such a split into two pieces of essentially equal breadth is possible, other splits, into more than two sub-hulls and/or non-symmetrical splits are also within the scope of this invention.

Figure 6:
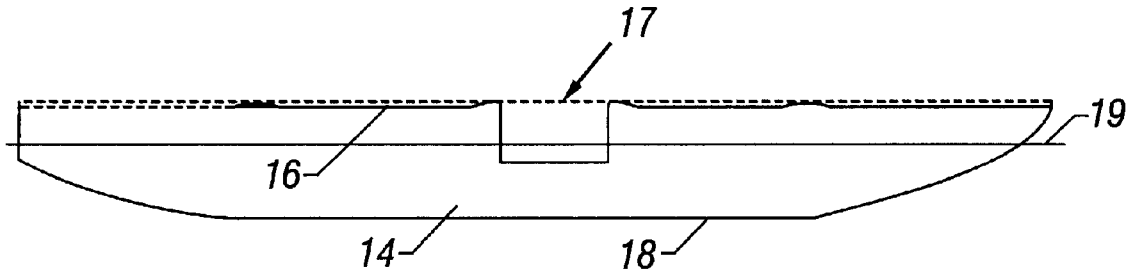
FIG. 6 shows a plan view of a recessed portion formed in one side of one of the sub-hulls.

As previously explained, each of the sub-hulls is designed and built to float as a separate ship. In one aspect of the invention, as shown in FIG. 6, a recessed area 17 formed into the side 16 of each sub hull 14 which is to be joined to another sub-hull 14 is designed and arranged to facilitate the balance of each of the sub-hulls and to reduce to an acceptable level the amount of list of each of the sub-hulls 14 when each sub-hull 14 is floating on its own. The recessed area 17—forms an opening through to the water below the vessel, such as a "moon pool", when the sub-hulls 14 are joined together. The volume of each of the recessed areas 17 is preferably such that the displaced volume on the "joined together" side 16 of each of the sub-hulls 14 is similar to the displaced volume on the "ship-shaped" 18 side of each of the sub-hulls 14 with respect to the geometric centerline 19 of each of the sub-hulls. The volume of the recessed area 17 materially assists in balancing each sub-hull 14 so that list of each sub-hull 14 is minimized. In a particular embodiment of this aspect of the invention, the volume, with respect to the center line 19 of each sub-hull 14, of the recessed area 17 can be selected so that the volume displaced on the "ship-shape" side 18 of the sub-hull substantially matches the volume displaced on the side to be joined 16 to the other sub-hull.

Each of the sub-hulls 14 may be provided with all of the individual safety requirements for a ship. All piping and electrical connections may be made over the main deck except for a possible connection of heeling tanks. Each of the sub-hulls 14 is designed to assure sufficient strength and stability both to be transported to the desired destination and to operate as a composed monohull vessel when assembled to the other sub-hull(s). Each separate sub-hull 14 each may be outfitted and arranged to sail on its own power to the desired destination. The dimensions of the sub-hulls 14 are preferably selected to be within the allowable limitations imposed by the waterways through which the sub-hulls 14 must pass to reach the desired destination. The superstructure and industrial systems for the assembled monohull vessel (10 in FIG. 1) may be transported to the desired location either separately, or on board one or more of the separate sub-hulls 14, and the fitted over the width of the composite vessel at the time of assembly of the vessel (10 in FIG. 1).

Figure 7:
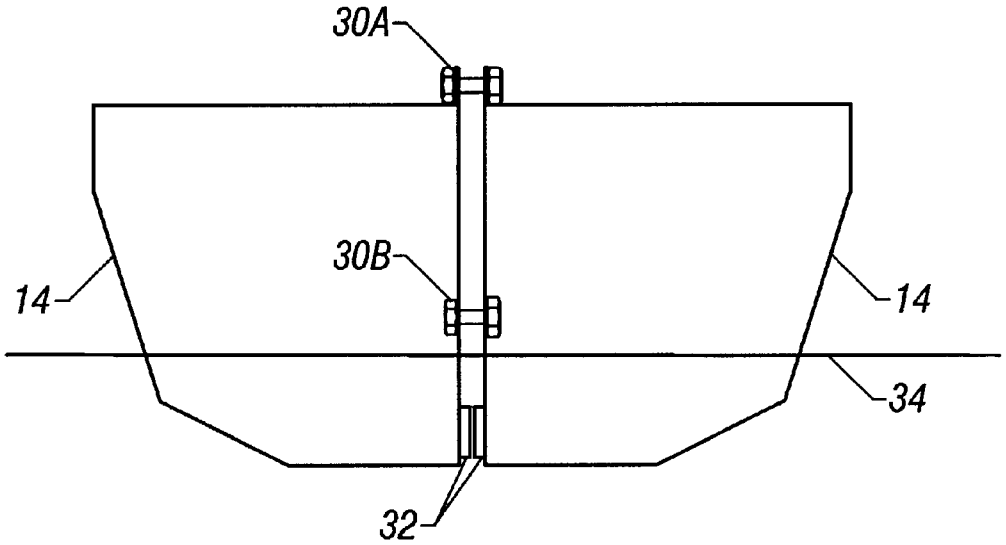
FIG. 7 shows a transverse view of two sub-hulls joined together to illustrate an example of couplings joining the sub-hulls.

The sub-hulls may be joined, as can be observed in FIG. 7, through the use of mechanical attachments comprising, for example, fixed bolted foundation fixtures located at both the main deck level 30A and between deck and keel level 30B. When such mechanical attachments are used to join the sub-hulls 14, an alignment mechanism is required only at deck level. Tension bolts are sufficient to be used in lower level 30B areas. In one embodiment of the invention foundation fixtures are placed as shown at 30A in FIG. 7 and at a selected distance below deck level which is above the vessel lightship waterline as shown at 30B, thus allowing access from above water to fasten and place the connecting bolts 30A, 30B. In this example at the bottom of the vessel, at keel level, contacting pads 32 may be provided to reduce the joining forces on the sub-hulls 14 when the vessel 10 sails in moderate to high wave conditions.

The sub-hulls 14 also may be joined by welding after transport to the desired location, when the dimensional restrictions imposed by the intermediate waterways are no longer applicable.

Figure 5A:
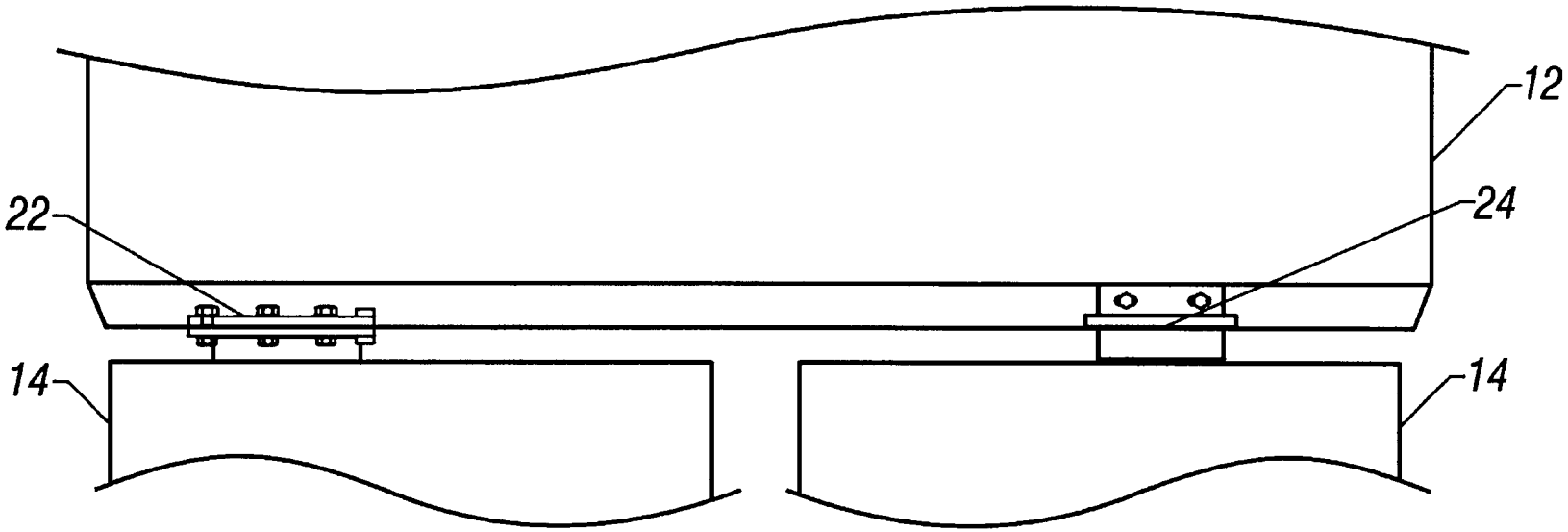
FIG. 5*a* shows a frontal view of the connection between the superstructure and the split hulls.
Figure 5C:
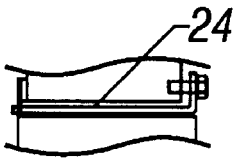
FIG. 5*c* shows a view of a sliding bolt foundation.
Figure 5B:
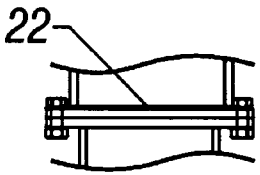
FIG. 5*b* shows a view of a fused bolt foundation.

Longitudinally, the joining connections could be made in the aft ship, in the fore ship, and at one or more locations in the moonpool area (the moonpool being formed, as previously explained, between the recessed portions 17 as two sub-hulls 14 are joined together), depending on the design of the moonpool, or at other longitudinal locations. The joining connection foundations should be designed and fabricated to withstand the combined interacting forces between or among the sub-hulls 14 both in still waters and under moderate to high wave conditions. Special sliding foundations can be provided for items, such as the superstructure, which are to be fitted over or otherwise supported on more than one of the sub-hulls 14. FIG. 5*a* shows an attachment of the superstructure 12 to two sub-hulls 14. The superstructure 12 is attached to one sub-hull 14 with a sliding bolt foundation 24 and attached to the other sub-hull 14 with a fused bolt foundation 22. The sliding foundation 24 serves to position the superstructure 12 in the desired alignment. A detailed view of the sliding bolt foundation 24 is shown in FIG. 5*c*. A detailed view of the fused bolt foundation 22 is shown in FIG. 5*b*.

While the invention has been disclosed with reference to specific examples of embodiments, numerous variations and modifications are possible. Therefore, it is intended that the invention not be limited by the description in the specification, but instead should be limited only by the claims that follow.

What is claimed is:

1. A vessel comprising:

at least two sub-hulls, each of the sub-hulls including a recessed portion therein on a side to be joined to a corresponding side on another of the sub-hulls; and an attachment mechanism that joins the sub-hulls together, wherein the recessed portion has a volume such that a displaced volume on said side to be joined is substantially the same as a displaced volume of the opposite side of the sub-hull with respect to a center line of the sub-hull to avoid listing when the sub-hulls are operated independently.

2. The vessel of claim 1, wherein the sub-hulls comprise independent vessels.

3. The vessel of claim 1, wherein the sub-hulls form a symmetrical monohull vessel when joined together.

4. The vessel of claim 1 wherein the attachment mechanism comprises bolted connections.

5. The vessel of claim 4 wherein the bolted connections are disposed at a deck level and at another vertical level above a lightship waterline, and further comprising contact pads near a keel level of each of the sub-hulls.

6. A method for assembling a vessel comprising:

providing at least two sub-hulls, each of the sub-hulls including a recessed portion therein on a side to be joined to a corresponding side on another of the sub-hulls; and attaching the sub-hulls together, wherein the recessed portion has a volume such that a displaced volume on said side to be joined is substantially the same as a displaced volume of the opposite side of the sub-hull with respect to a center line of the sub-hull to avoid listing when the sub-hulls are operated independently; and attaching the sub-hulls together.

7. The method of claim 6, wherein the sub-hulls comprise independent vessels.

8. The method of claim 6, wherein the sub-hulls form a symmetrical monohull vessel upon the attaching.

9. The method of claim 6 wherein the attaching is performed with a bolts placed at discrete longitudinal positions along the vessel.

10. The method of claim 6 wherein the attaching is performed with bolts disposed at deck level and bolts disposed at another lower level above the lightship waterline and contact pads disposed near keel level.

* * * * *